US008861175B2

(12) United States Patent
Godo et al.

(10) Patent No.: US 8,861,175 B2
(45) Date of Patent: Oct. 14, 2014

(54) POWER SEMICONDUCTOR DEVICE FOR IGNITER

(75) Inventors: Shinsuke Godo, Tokyo (JP); Kazuhiro Nishimura, Fukuoka (JP); Kazuki Yamada, Fukuoka (JP)

(73) Assignee: Mitsubishi Electric Corporation, Tokyo (JP)

( * ) Notice: Subject to any disclaimer, the term of this patent is extended or adjusted under 35 U.S.C. 154(b) by 930 days.

(21) Appl. No.: 12/877,538

(22) Filed: Sep. 8, 2010

(65) Prior Publication Data

US 2011/0141651 A1 Jun. 16, 2011

(30) Foreign Application Priority Data

Dec. 15, 2009 (JP) ..... 2009-284099

(51) Int. Cl.
*F23Q 3/00* (2006.01)

(52) U.S. Cl.
CPC ..... *F23Q 3/004* (2013.01)
USPC ..... 361/263

(58) Field of Classification Search
CPC ..... F23Q 3/00; F23Q 3/004; F02P 3/05; F02P 3/055
USPC ..... 361/263
See application file for complete search history.

(56) References Cited

U.S. PATENT DOCUMENTS

| | | | | |
|---|---|---|---|---|
| 3,734,676 | A * | 5/1973 | Wyland | 431/79 |
| 4,092,552 | A * | 5/1978 | Hoehn | 327/577 |
| 6,814,066 | B2 * | 11/2004 | Ando | 123/644 |
| 2002/0176215 | A1 | 11/2002 | Hiyama et al. | |
| 2005/0061307 | A1 * | 3/2005 | Naruse et al. | 123/618 |
| 2005/0178372 | A1 * | 8/2005 | Kesler et al. | 123/630 |
| 2006/0077000 | A1 | 4/2006 | Goudo | |

FOREIGN PATENT DOCUMENTS

| | | | |
|---|---|---|---|
| CN | 101174619 | A | 5/2008 |
| JP | 8-338350 | | 12/1996 |
| JP | 2001-248529 | | 9/2001 |
| JP | 2002-235643 | A | 8/2002 |
| JP | 2006-109286 | | 4/2006 |
| JP | 2006109286 | A * | 4/2006 |
| JP | 2008-45514 | | 2/2008 |

OTHER PUBLICATIONS

Japanese Office Action issued Mar. 26, 2013, in Japan Patent Application No. 2009-284099 (with Partial English translation).

(Continued)

*Primary Examiner* — Rexford Barnie
*Assistant Examiner* — Ann Hoang
(74) *Attorney, Agent, or Firm* — Oblon, Spivak, McClelland, Maier & Neustadt, L.L.P.

(57) ABSTRACT

A power semiconductor device for an igniter comprises: a semiconductor switching device causing a current to flow through a primary side of an ignition coil or shutting off the current; and an integrated circuit driving and controlling the semiconductor switching device, wherein the integrated circuit includes: a first discharge device discharging charge accumulated on a control terminal of the semiconductor switching device and shutting off the semiconductor switching device so as to generate ignition plug spark voltage on a secondary side of the ignition coil during a normal operation; and a second discharge device slower discharging the charge accumulated on the control terminal in comparison with the first discharge device and shutting off the semiconductor switching device so that a voltage on the second side of the ignition coil is equal to or lower than the ignition plug spark voltage during an abnormal state.

7 Claims, 11 Drawing Sheets

(56) References Cited

OTHER PUBLICATIONS

Combined Chinese Office Action and Search Report Issued Jan. 22, 2013 in Patent Application No. 201010609296.9 (with partial English translation and English translation of Categories of Cited Documents).
U.S. Appl. No. 12/877,348, filed Sep. 8, 2010, Godo, et al.
U.S. Appl. No. 12/877,435, filed Sep. 8, 2010, Godo, et al.
Chinese Office Action issued Jul. 24, 2013, in China Patent Application No. 201010609296.9 (with Partial English translation).
Combined Office Action and Search Report issued Dec. 17, 2013 in Chinese Patent Application No. 201010609296.9 with partial English language translation and English translation of categories of cited documents.

* cited by examiner

POWER SEMICONDUCTOR DEVICE FOR IGNITER

BACKGROUND OF THE INVENTION

1. Field of the Invention

The present invention relates to a power semiconductor device for an igniter having an overheat protection function to protect a semiconductor switching device at an abnormally high temperature in an ignition system for an internal combustion engine.

2. Background Art

An ignition system for an internal combustion engine such as an automobile engine has, as components for generating a high voltage to be applied to an ignition plug, and a power semiconductor device incorporating an ignition coil (inductive load), a semiconductor switching device for driving the ignition coil and a circuit device (semiconductor integrated circuit) for controlling the semiconductor switching device. These components constitute a so-called igniter. The ignition system also has an engine control unit (ECU) including a computer. In ordinary cases, a protection function for protecting the semiconductor switching device in the event of occurrence of an abnormality in operation such as abnormal heat generation or application of an on-signal for a predetermined constant time period or longer by sensing the abnormality and forcibly shutting off the current flowing through the semiconductor switching device is provided in the power semiconductor device (see, for example, Japanese Patent Laid-Open No. 8-338350).

Because the overheat protection function is an operation according to self-protection of the power semiconductor device, timing of shutting off in the power semiconductor device is performed independently of ignition signal timing performed by the ECU. There is, therefore, a possibility of ignition occurring at an inappropriate time in the ignition sequence as a result of a shutoff operation in the overheat protection function to cause a backfire or knocking in the engine.

As a measure against the problem, methods have been proposed for softly shutting off the current so as not to cause ignition at the time of shutting off, i.e., for preventing an unnecessary ignition operation by setting the speed of shutting off the current flowing through the primary side of the ignition coil low enough to avoid inducing arc discharge on the ignition plug (see, for example, Japanese Patent Laid-Open Nos. 2001-248529 and 2008-45514).

SUMMARY OF THE INVENTION

In the protection function of the conventional power semiconductor device for igniters, realization of soft shutoff by preventing the ignition plug from sparking in the event of an abnormality requires the provision of a circuit for producing a time constant of about 10 to 100 msec. Forming such a kind of circuit in the semiconductor integrated circuit entails a problem that the chip size is increased or the number of manufacturing steps is increased.

Japanese Patent Laid-Open No. 2001-248529 discloses an example of a circuit with which soft shutoff is realized by reducing in a stepping manner a reference voltage for an amplifier performing feedback in a current limiting circuit which limits the collector current through a semiconductor switching device. Japanese Patent Laid-Open No. 2008-45514 also discloses an example of a circuit with which soft shutoff is realized by reducing at a low rate a reference voltage for an amplifier for a current limiting circuit. In each of these circuits, the reference voltage for the current limiting amplifier is changed to reduce the current limit value. In this way, soft shutoff of a semiconductor switching device is achieved.

Each of soft shutoff functions according to the above-described related arts entails a problem that the mechanism for changing the reference voltage is complicated. Also, in most cases, a high-accuracy amplifier and an accurate reference voltage are required as the amplifier and the reference voltage for the above-described current-limiting circuit. However, an arrangement for changing a reference voltage as in the related arts cannot be said to be preferable from the viewpoint of maintaining a high degree of accuracy. Further, the related arts also have a problem that changing the reference voltage is disadvantageous to the amplifier in terms of control stability, and a problem that it is necessary to use an amplifier of a complicated configuration in order to increase the in-phase input range.

In view of the above-described problems, an object of the present invention is to provide a highly reliable power semiconductor device for igniters capable of realizing a soft shutoff function for reliably protecting a semiconductor switching device in the event of occurrence of an abnormality with a simple configuration.

According to the present invention, a power semiconductor device for an igniter comprises: a semiconductor switching device causing a current to flow through a primary side of an ignition coil or shutting off the current flowing through the primary side of the ignition coil; and an integrated circuit driving and controlling the semiconductor switching device, wherein the integrated circuit includes: a first discharge device discharging charge accumulated on a control terminal of the semiconductor switching device and shutting off the semiconductor switching device so as to generate ignition plug spark voltage on a secondary side of the ignition coil during a normal operation; and a second discharge device slower discharging the charge accumulated on the control terminal of the semiconductor switching device in comparison with the first discharge device and shutting off the semiconductor switching device so that a voltage on the second side of the ignition coil is equal to or lower than the ignition plug spark voltage during an abnormal state.

When the semiconductor switching device is shut off by discharging charge accumulated on the control terminal of the semiconductor switching device in the event of occurrence of an abnormality, the charge is discharged by other discharge device for slower discharging in comparison with the discharge device in the ordinary operation. In this way, soft shutoff can be realized with a simple configuration. Since there is no need to change a reference voltage for a current limiting function for soft shutoff, there is no influence on the stability of control.

Other and further objects, features and advantages of the invention will appear more fully from the following description.

DETAILED DESCRIPTION OF THE PREFERRED EMBODIMENTS

First Embodiment

Figure 1:
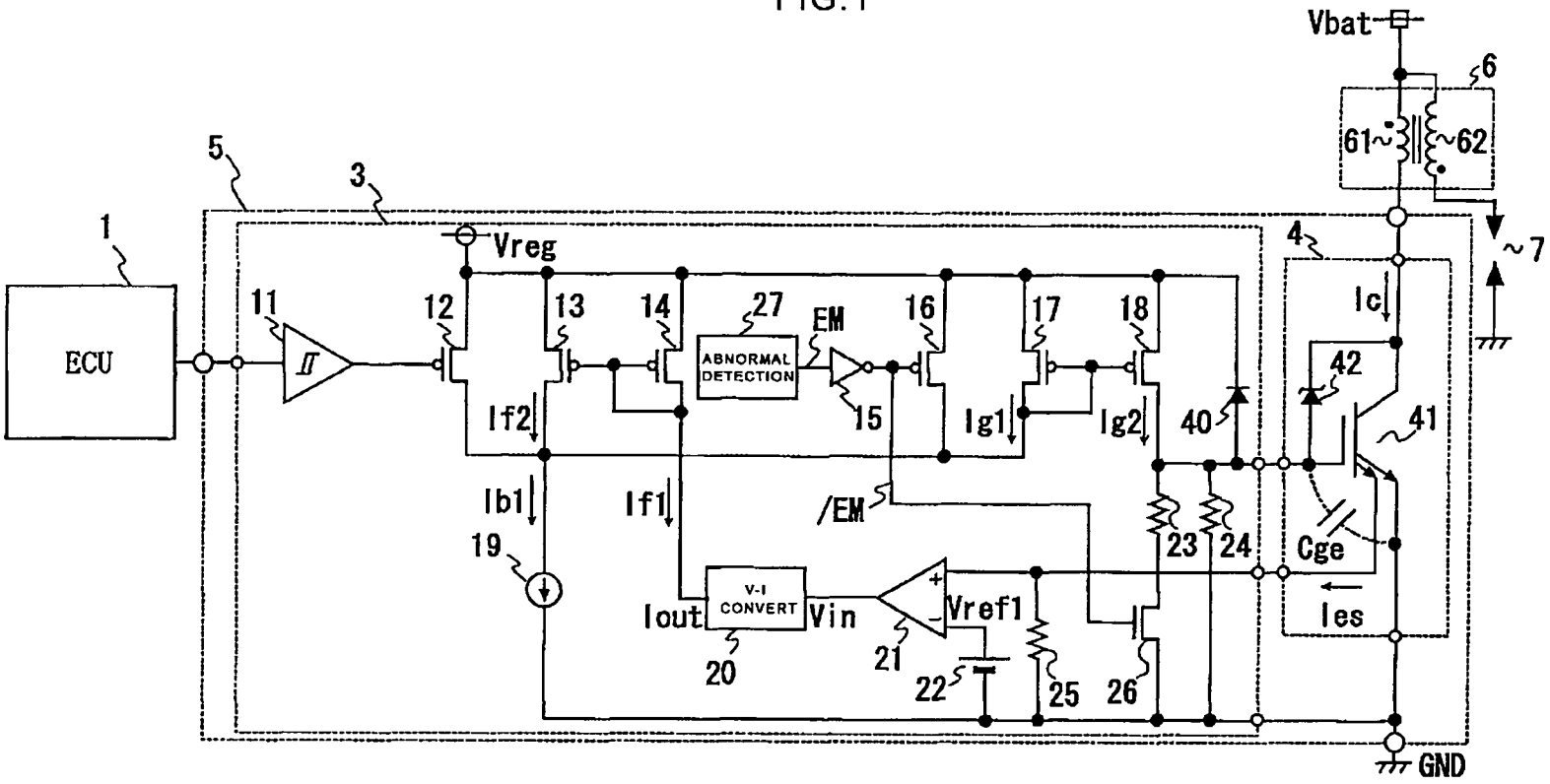
FIG. 1 is a circuit diagram showing an ignition system according to a first embodiment of the present invention.

FIG. 1 shows an embodiment of an ignition system according to the present invention. In the ignition system shown in FIG. 1, a power supply Vbat such as a battery is connected to one end of a primary coil 61 in an ignition coil 6, while a power semiconductor device 5 for an igniter (hereinafter referred to as "an igniter power semiconductor device") is connected to the other end of the primary coil 61. The power supply Vbat is also connected to one end of a secondary coil 62, and an ignition plug 7 having one end grounded is connected to the other end of the secondary coil 62. An ECU 1 outputs a control input signal for driving a semiconductor switching device 41 to the igniter power semiconductor device.

In this ignition system, the igniter power semiconductor device 5 has a semiconductor switching device 4 including an insulated gate bipolar transistor (IGBT) 41 for causing a current to flow through the primary coil 61 or shutting off the current flowing through the primary coil 61, and an integrated circuit 3 for driving and controlling the IGBT 41 according to the control signal from the ECU 1 and other operating conditions.

As the IGBT 41, which is a main component of the semiconductor switching device 4, an IGBT having, in addition to the ordinary electrode terminals, i.e., the collector, emitter and gate, a sense emitter for sensing the collector current Ic, through which a current proportional to (for example, about 1/1000 of) the collector current flows is adopted. Also, a Zener diode 42 provided for protection against a surge voltage is connected between the collector and the gate in the reverse direction.

Figure 2:
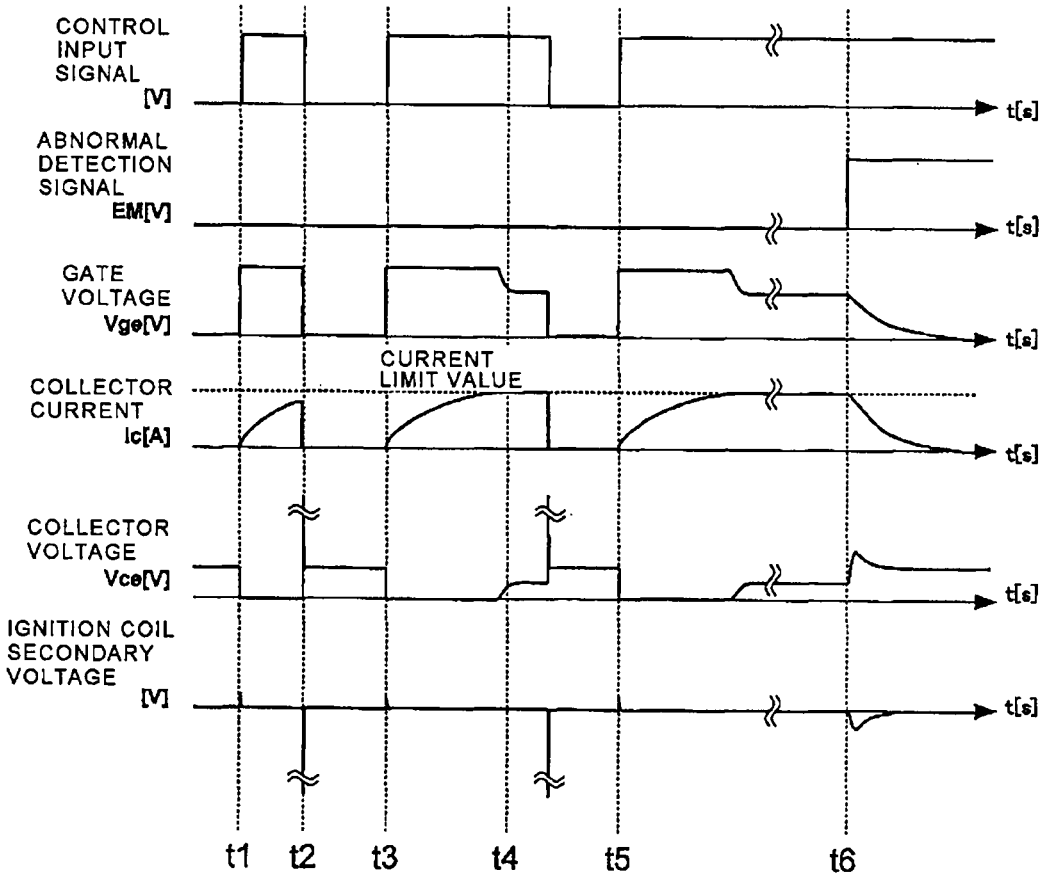
FIG. 2 is a timing chart for illustrating the operation of the ignition system according to the first embodiment of the present invention.

The functions of the integrated circuit 3 and the ignition operation of the entire ignition system will now be described with reference to the timing chart of FIG. 2.

The normal operation will first be described. A high-level control input signal applied at time t1 from the ECU 1 to an input terminal of the integrated circuit 3 undergoes waveform shaping in a Schmitt trigger circuit 11 and thereafter turns off a first Pch MOS 12.

An abnormality detection signal EM output from an abnormality detection circuit 27 is low level, while an inverted abnormality detection signal /EM output through a first NOT circuit 15 is high level. (While an inverted signal is ordinarily expressed by adding an overbar on a symbol for the original signal, an alternative expression is made by adding a slash before a symbol for the original signal in this specification.) By the inverted abnormality detection signal /EM, a second Pch MOS 16 is also turned off.

A first current mirror circuit constituted by a third Pch MOS 17 and a fourth Pch MOS 18 then operates.

A reference-side current value Ig1 of the first current mirror circuit is equal to the result of subtraction of an output current value If2 of a current-limiting circuit described below from an output current value Ib1 of a constant-current source 19. With respect to this reference-side current Ig1, a current Ig2 according to the mirror ratio of the first current mirror circuit is produced as an output current.

The inverted abnormality detection signal /EM turns on a first Nch MOS 26 connected to a first resistor 23 in series, thereby connecting the first resistor 23 to a reference power supply potential GND. Accordingly, the load impedance of the first current mirror circuit is the parallel connection of the first resistor 23 and a second resistor 24.

The resistance of the first resistor 23 is several tens of kiloohms. The resistance of the second resistor 24 is set in advance about 100 times larger than the resistance of the first resistor 23, i.e., several megaohms. Accordingly, the resistance of the parallel connection of these two resistors is about several ten kiloohms. That is, only the first resistor 23 mainly contributes to the load impedance of the first current mirror circuit.

Therefore, almost the entire output current Ig2 of the first current mirror circuit flows through the first resistor 23. A gate drive voltage to the IGBT 41 is thereby generated to turn on the IGBT 41. At this time, a collector current Ic such as shown in FIG. 2 flows through the primary coil 61 and the IGBT 41 according to a time constant determined by the inductance and the wiring resistance of the primary coil 61.

A low-level control input signal is applied at time t2 from the ECU 1. The first Pch MOS 12 is thereby turned on to stop the first current mirror circuit. Charge accumulated on the gate of the IGBT 41 is discharged in an extremely short time almost entirely through the first resistor 23 and the first Nch MOS 26 forming first discharge device. As a result, the IGBT 41 is rapidly shut off.

At this time, a high voltage of about 500 V is generated on the collector terminal of the IGBT 41 by the primary coil 61 in the direction to maintain the current that has been flowing. This voltage is boosted to about 30 kV according to the winding ratio of the ignition coil 6 to cause the ignition plug 7 connected to the secondary coil 62 to spark.

A case where the high-level control input signal is applied from the ECU 1 for a comparatively long energization time period from time t3 will be described.

By the application of the high-level control input signal from the ECU 1, the collector current Ic is gradually increased from time t3 in the way described above. However, a current limit value for inhibiting the collector current Ic from becoming equal to or higher than a predetermined constant value is set for the purpose of preventing melting of the winding of the ignition coil 6 and magnetic saturation of the transformer.

Limiting of the collector current Ic is realized by a mechanism described below. A sense current Ies from the IGBT 41 flows through a third resistor 25 in the integrated circuit 3 to generate a voltage across the third resistor 25 according to the collector current Ic of the IGBT 41. This voltage is compared with a voltage Vref1 of a first reference voltage supply 22 by an amplifier 21. A V-I conversion circuit 20 outputs a current If1 according to the difference between the compared values.

From this current If1, a second current mirror circuit constituted by a fifth Pch MOS 13 and a sixth Pch MOS 14 produces an output current according to its mirror ratio. This output current is output as a current-limiting signal If2. The current-limiting signal If2 acts in the direction to reduce the current Ig2 from which the gate drive voltage to the IGBT 41 is generated. As a result, the gate voltage is reduced to inhibit the collector current Ic from increasing. That is, the entire system operates in a negative feedback manner with respect to the collector current Ic, thereby limiting the collector current Ic to a predetermined constant value.

When the collector current Ic becomes equal to the current limit value at time t4, the gate voltage to the IGBT 41 is lower and the IGBT 41 operates in pentode fashion. That is, while the collector current Ic is flowing, the collector voltage is not sufficiently reduced; Joule loss is being produced in the IGBT 41.

The operation in a case where a continuous-energization state, which is an abnormal state, occurs at time t5 will be described. In the example shown in FIG. 2, the high level of the control input signal is maintained even when the control input signal should become low level after a lapse of a predetermined constant time period.

As described above, in a case where the energization time is comparatively long, a Joule loss is being caused in the IGBT 41 by the current limiting function. If this state lasts long, the chip temperature is considerably increased. Therefore a protection function to turn off the IGBT 41 to ensure that the allowable loss is not exceeded is required.

When at time t6 the abnormality detection circuit 27 detects a continuous-energization state lasting longer than a predetermined time period or an abnormal increase in chip temperature, it sets the abnormal detection signal EM to high level and sets the inverted abnormal detection signal /EM to low level through the NOT circuit 15. The second Pch MOS 16 is thereby turned on to stop the first current mirror circuit. The first Nch MOS 26 is also turned off thereby.

At this time, only the second resistor 24 having a resistance of several megaohms is connected as second discharge device between the gate terminal of the IGBT 41 and the reference power supply potential GND. The IGBT 41 ordinarily has a gate capacitance Cge of about 1000 pF. Charge accumulated on the gate of the IGBT 41 is slowly discharged with a time constant of about several milliseconds to several ten milliseconds. Soft shutoff is thus realized, such that the IGBT 41 is shut off without causing the ignition plug, to spark.

Second Embodiment

Figure 3:
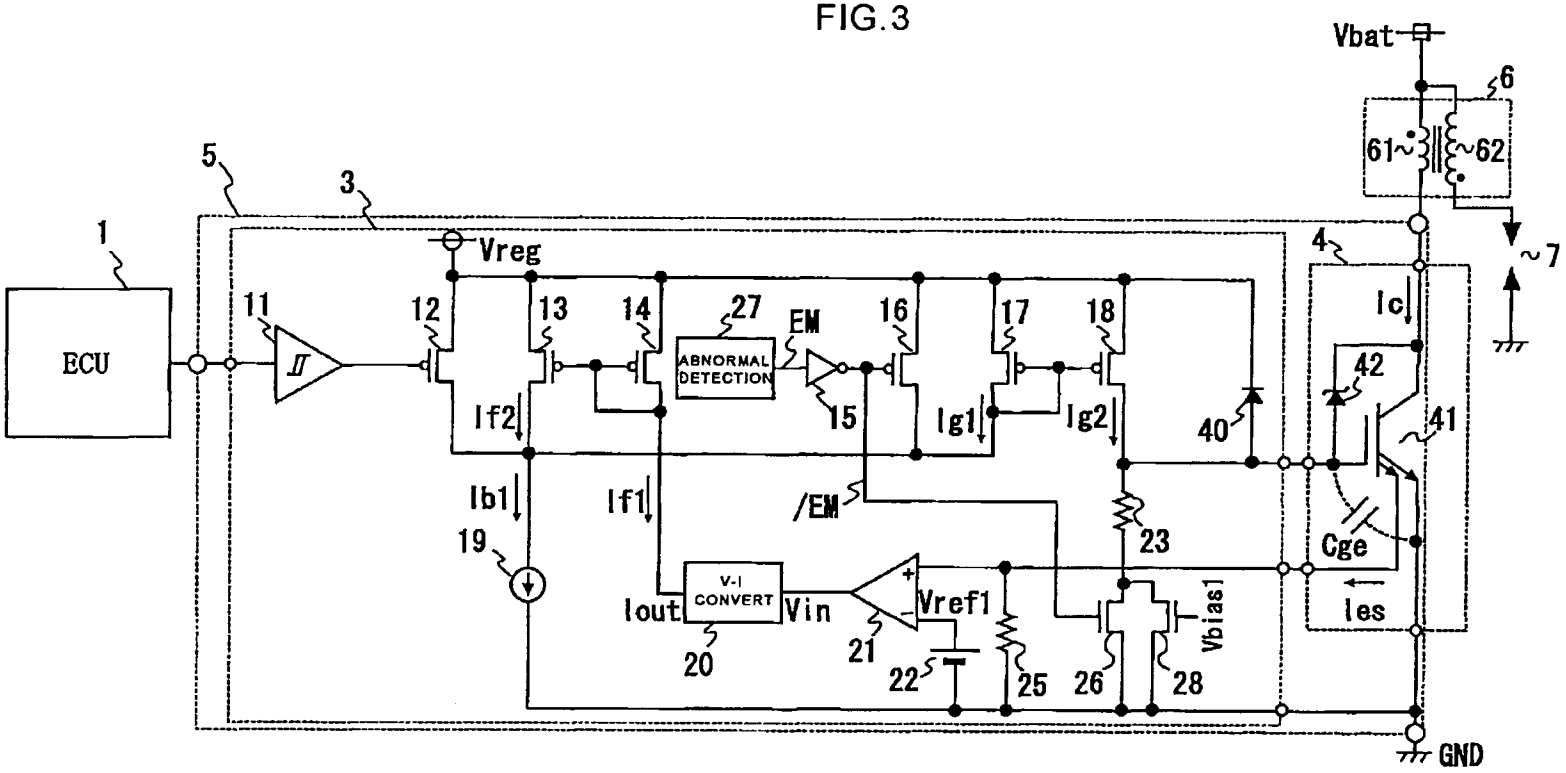
FIG. 3 is a circuit diagram showing an ignition system according to a second embodiment of the present invention.

FIG. 3 shows a second embodiment of the igniter power semiconductor device according to the present invention. In the figures referred to below, components equivalent in function to those in the first embodiment are indicated by the same reference characters. Description will not be redundantly made for them.

In the second embodiment, a constant-current source is used as the second discharge device in place of the second resistor 24 in the first embodiment. FIG. 3 shows an example of use of a second Nch MOS 28 as a constant-current source. The second Nch MOS 28 is connected in parallel with the first Nch MOS 26 and has its gate terminal connected to a first fixed voltage Vbias1.

The constant-current value of the Nch MOS 28 is set to about 0.5 to 1 microamperes by adjusting the gate width, the gate length and the fixed voltage Vbias1. As this constant-current value, a value sufficiently smaller than (about 1/100 of) the discharge current flowing through the first resistor 23 provided as the first discharge device.

Figure 4:
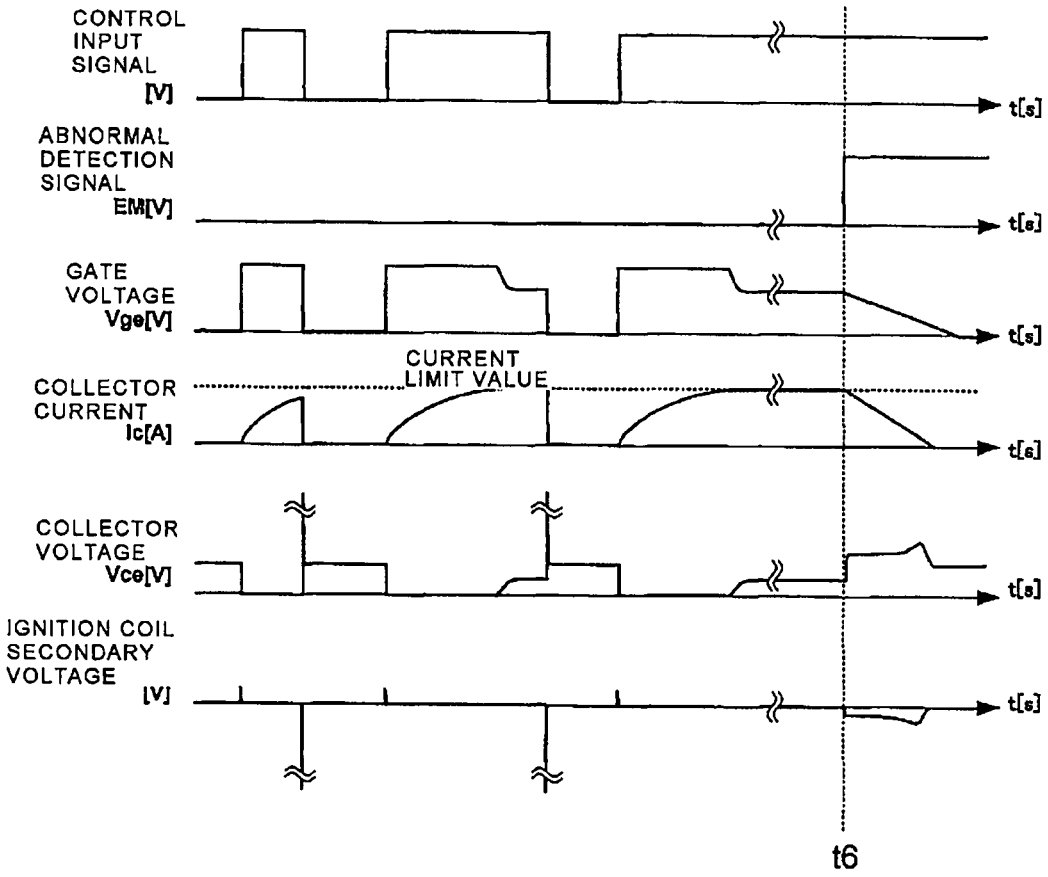
FIG. 4 is a timing chart for illustrating the operation of the ignition system according to the second embodiment of the present invention.

FIG. 4 shows a timing chart in the present embodiment. The abnormality detection signal EM is set to high level at time t6 by the abnormality detection circuit 27, as in the first embodiment.

During the normal operation, the inverted abnormality detection signal /EM is high level and the first Nch MOS 26 is on. Accordingly, charge accumulated on the gate electrode of the IGBT 41 is discharged almost entirely through the first resistor 23, the first discharge device.

At time t6, the abnormality detection signal EM becomes high level and the inverted abnormality detection signal /EM becomes low level. The first Nch MOS 26 is then turned off. At this time, charge accumulated on the gate electrode of the IGBT 41 is discharged via the route: the first resistor 23—the second Nch MOS 28 (the constant-current source)—the reference power supply potential GND, thus realizing soft shutoff.

For soft shutoff in the present embodiment, discharge is performed by means of the constant-current source, as described above. Accordingly, the gate voltage on the IGBT 41 decreases linearly and a change in the rate of attenuation of the collector current Ic is small, as shown in FIG. 4. Therefore, the peak value of the secondary voltage across the ignition coil 6 generated by starting soft shutoff at t6 can be reduced in comparison with the case of discharge through the second resistor 24 in the first embodiment.

As the second discharge device in the first embodiment, the second resistor 24 is used. However, the necessary resistance of the resistor 24 is high, several megaohms, and the resistor 24 occupies a comparatively large chip area on the integrated circuit 3. In contrast, in the present embodiment, since a constant-current source formed of an Nch MOS is used, the same function can be realized while occupying an area smaller than that in the first embodiment, thus enabling the integrated circuit 3 to be further reduced in size.

Third Embodiment

At the time of soft shutoff in the first or second embodiment, gate charge on the IGBT 41 is discharged through the second resistor 24 having a comparatively high resistance value or through the second Nch MOS 28 as a constant-current source set to a comparatively small constant current value. This is equivalent to grounding of the gate terminal of the IGBT 41 with a high impedance, and means that the susceptibility to external noise is high.

In the present embodiment, control terminal voltage observation means for monitoring the gate terminal voltage on the IGBT 41 is provided to promptly discharge gate charge by the first discharge device when the gate voltage becomes equal to or lower than the threshold value of the IGBT 41.

Figure 5:
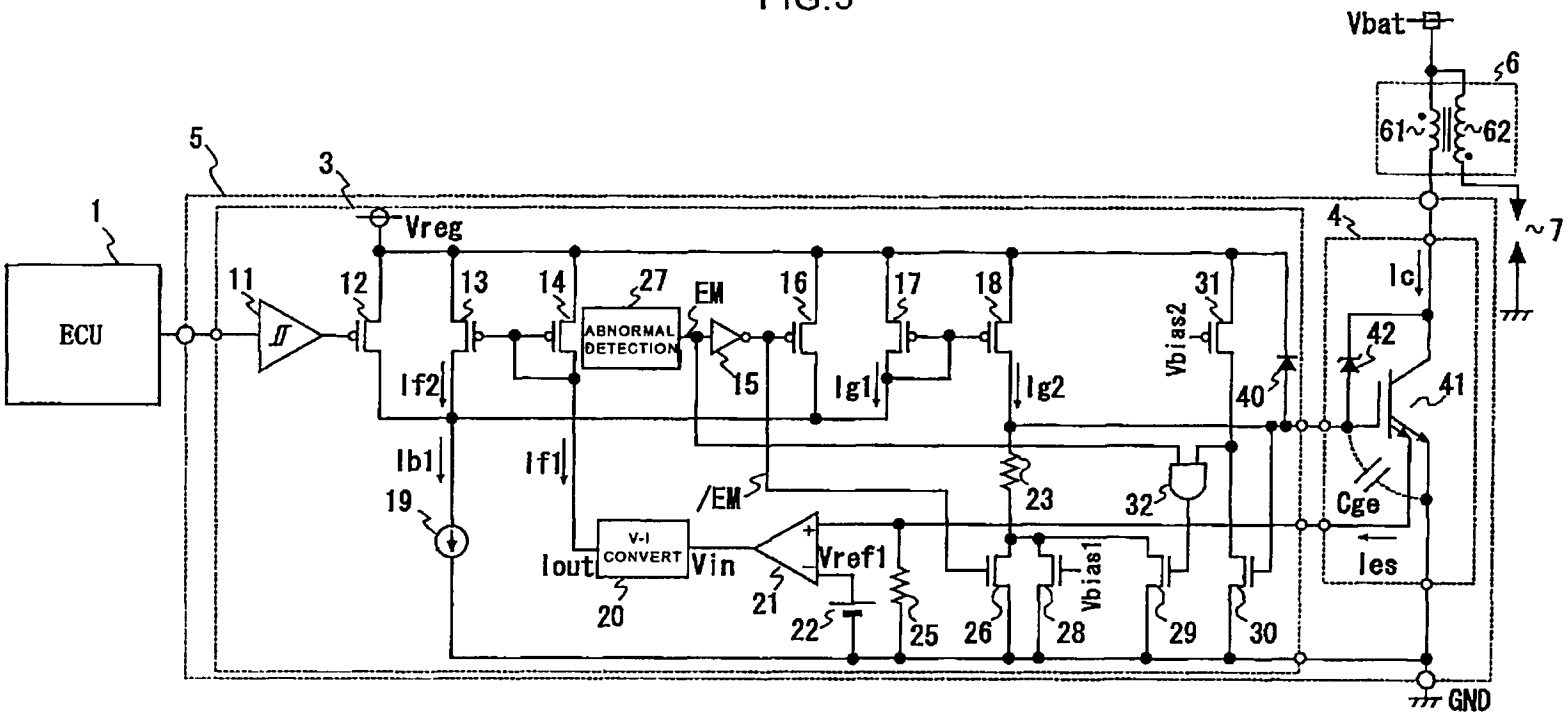
FIG. 5 is a circuit diagram showing an ignition system according to a third embodiment of the present invention.
Figure 6:
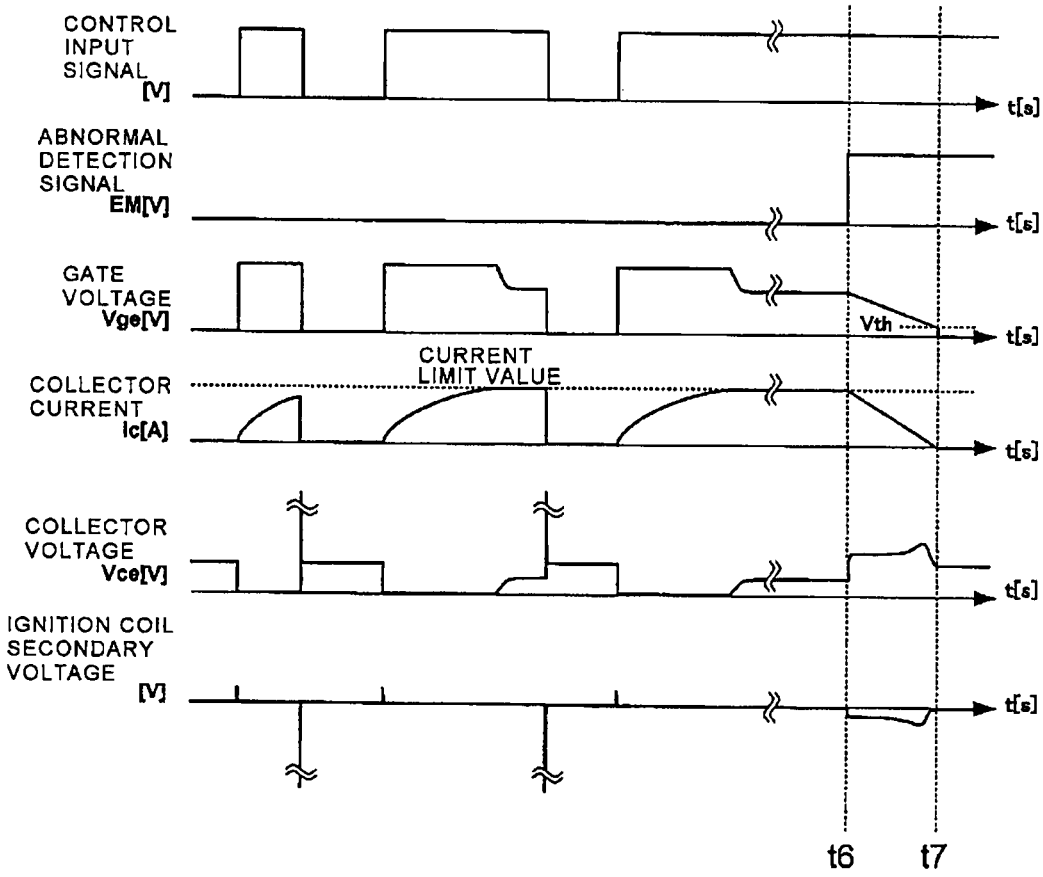
FIG. 6 is a timing chart for illustrating the operation of the ignition system according to the third and the sixth embodiments of the present invention

FIG. 5 shows a third embodiment of the igniter power semiconductor device according to the present invention. FIG. 6 shows a timing chart for explaining the operation in the third embodiment. Referring to FIG. 5, components provided as the control terminal voltage observation means are a seventh Pch MOS 31 operating as a constant-current source biased with a second fixed voltage Vbias2, a third Nch MOS 30 having this constant-current source as an active load and having a gate input from the gate terminal of the IGBT 41, a first AND circuit 32 which outputs the logical product of the drain voltage on the third Nch MOS 30 and the abnormality detection signal EM, and a fourth Nch MOS 29 driven by the first AND circuit 32 to make effective the first discharge device.

The seventh Pch MOS 31 and the third Nch MOS 30 operate as a logical inversion circuit having the gate voltage on the IGBT 41 input therein. The MOS size of this logical inversion circuit and the second fixed voltage Vbias2 are set in advance so that the threshold value of the logical inversion circuit is the same as the threshold voltage Vth of the IGBT 41.

During the normal operation, the abnormality detection signal EM is low level. Accordingly, the output from the first AND circuit 32 is always low level independently of the gate voltage on the IGBT 41, and the fourth Nch MOS 29 is always off. That is, the normal operation is completely the same as that in the second embodiment.

A case where the abnormality detection signal EM becomes high level at time t6 at which an abnormal state occurs will be described. Immediately after detecting an abnormality, the gate voltage on the IGBT 41 is higher than the threshold voltage Vth. Accordingly, the third Nch MOS 30 is on and the drain voltage is low level. The output from the first AND circuit 32 is also low level and the fourth Nch MOS 29 is also maintained in the off-state. Accordingly, the soft shutoff operation is started, as described above in the description of the second embodiment.

With the progress of the soft shutoff operation, the gate voltage on the IGBT 41 reaches the threshold value Vth at time t7. The third Nch MOS 30 is thereby turned off to change the drain voltage to high level. Accordingly, the output from the first AND circuit 32 becomes high level and the fourth Nch MOS 29 is turned on.

By turning-on of the fourth Nch MOS 29, the first resistor 23 is connected to the reference power supply potential GND. As a result, gate charge on the IGBT 41 is rapidly discharged. The collector current Ic through the IGBT 41 has already become substantially zero. Therefore, even if the soft shutoff is abandoned at this stage to rapidly discharge gate charge, the secondary voltage across the ignition coil 6 is not excited strongly enough to cause the ignition plug 7 to spark.

That is, soft shutoff is performed by the second discharge device with a high impedance immediately after the detection of an abnormality, and a switch from the second discharge device to the first discharge device with a low impedance is quickly made at the end of a lapse of time with which the ignition coil 6 loses the energy high enough to cause the ignition plug 7 to spark, thus preventing the IGBT 41 from being again turned on by external noise.

Fourth Embodiment

Figure 7:
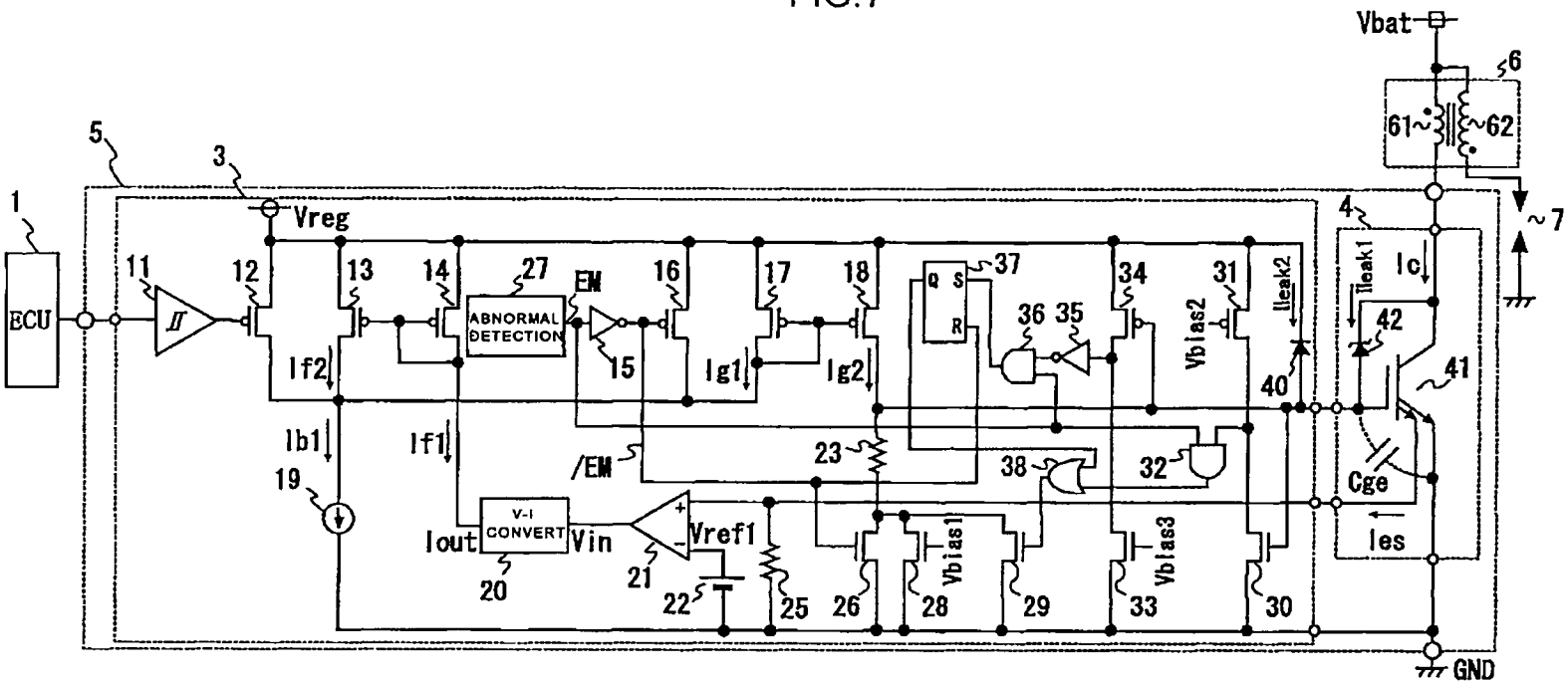
FIG. 7 is a circuit diagram showing an ignition system according to a fourth embodiment of the present invention.

FIG. 7 shows a fourth embodiment of the igniter power semiconductor device according to the present invention. Ordinarily, a surge protection diode 40 is inserted between each terminal of the integrated circuit and the power supply for the purpose of protecting the internal circuit against an external surge, as shown in FIG. 7. During the normal operation, the surge protection diode 40 has no influence on the operation. However, when the chip temperature is high, there is a possibility of generation of leak currents Ileak2 and Ileak1 through the surge protection diode 40 and the Zener diode 42 mounted on the semiconductor switching device 4, and leakage of the leak currents to the gate terminals.

In the igniter power semiconductor device according to the present invention, soft shutoff at abnormality detection in the case of the operation at an abnormally high temperature is performed by means of the second discharge device with a high impedance, as described above. There is, therefore, an anxiety about an increase in the gate voltage due to the leak currents Ileak1 and Ileak2 during operation at an abnormally high temperature leading to failure to perform shutoff.

In the present embodiment, if the gate voltage cannot be reduced under the influence of the leak currents during operation at an abnormally high temperature, an emergency step of making the first discharge device effective is taken to promptly perform shutoff.

Figure 8:
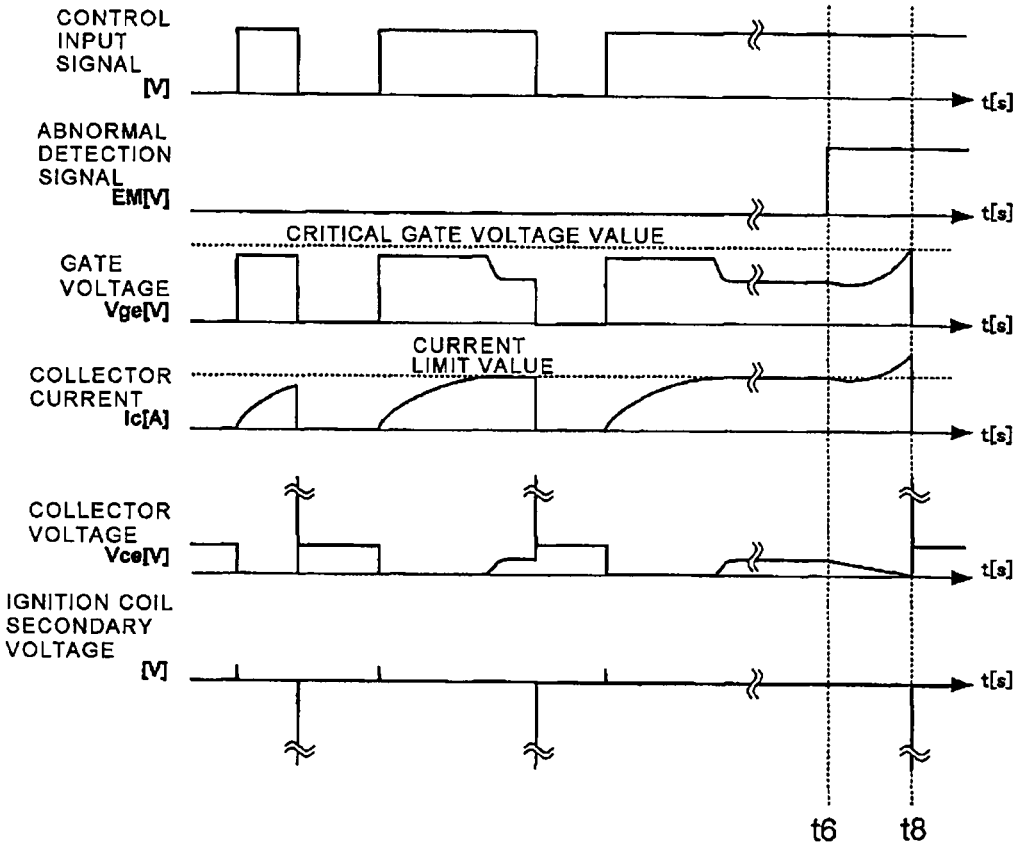
FIG. 8 is a timing chart for illustrating the operation of the ignition system according to the fourth embodiment of the present invention.

FIG. 8 shows a timing chart for explaining the operation in the present embodiment. Control terminal voltage observation means in the present embodiment has a circuit for performing fast discharge when the gate voltage is not reduced in case of operation at an abnormality high temperature in addition to the circuit for promptly discharging when the gate voltage becomes equal to or lower than the threshold value Vth in the third embodiment.

The threshold value of a logical inversion circuit constituted by an eighth Pch MOS 34 and a fifth Nch MOS 33 biased with a third fixed voltage Vbias3 is set in advance so that the output is inverted when the gate voltage rises to a value (critical gate voltage value) at which the first discharge device is to be made effective during operation at an abnormally high temperature.

When at time t6 the abnormality detection signal EM becomes high level, the second discharge device with a high impedance is made effective, as described above. If at this time the operation ambient temperature is so abnormally high that the surge protection diode 40 or the Zener diode 42 leaks, the gate voltage on the IGBT 41 starts temporarily decreasing, but the second discharge device cannot fully draw in the leak currents Ileak1 and the Ileak2 and the gate voltage starts, conversely, rising.

When at time t8 the gate voltage reaches the critical gate voltage, a latch 37 is set to turn on the fourth Nch MOS 29. The first discharge device with a low impedance is thereby made effective to rapidly reduce the gate voltage.

Since the collector current Ic is rapidly shut off in this case, a voltage high enough to cause the ignition plug 7 to spark is generated on the secondary side of the ignition coil 6. However, the shutoff of the IGBT 41 is maintained by the latch 37 until the abnormal state is dissolved, thus protecting the IGBT 41.

Fifth Embodiment

Figure 9:
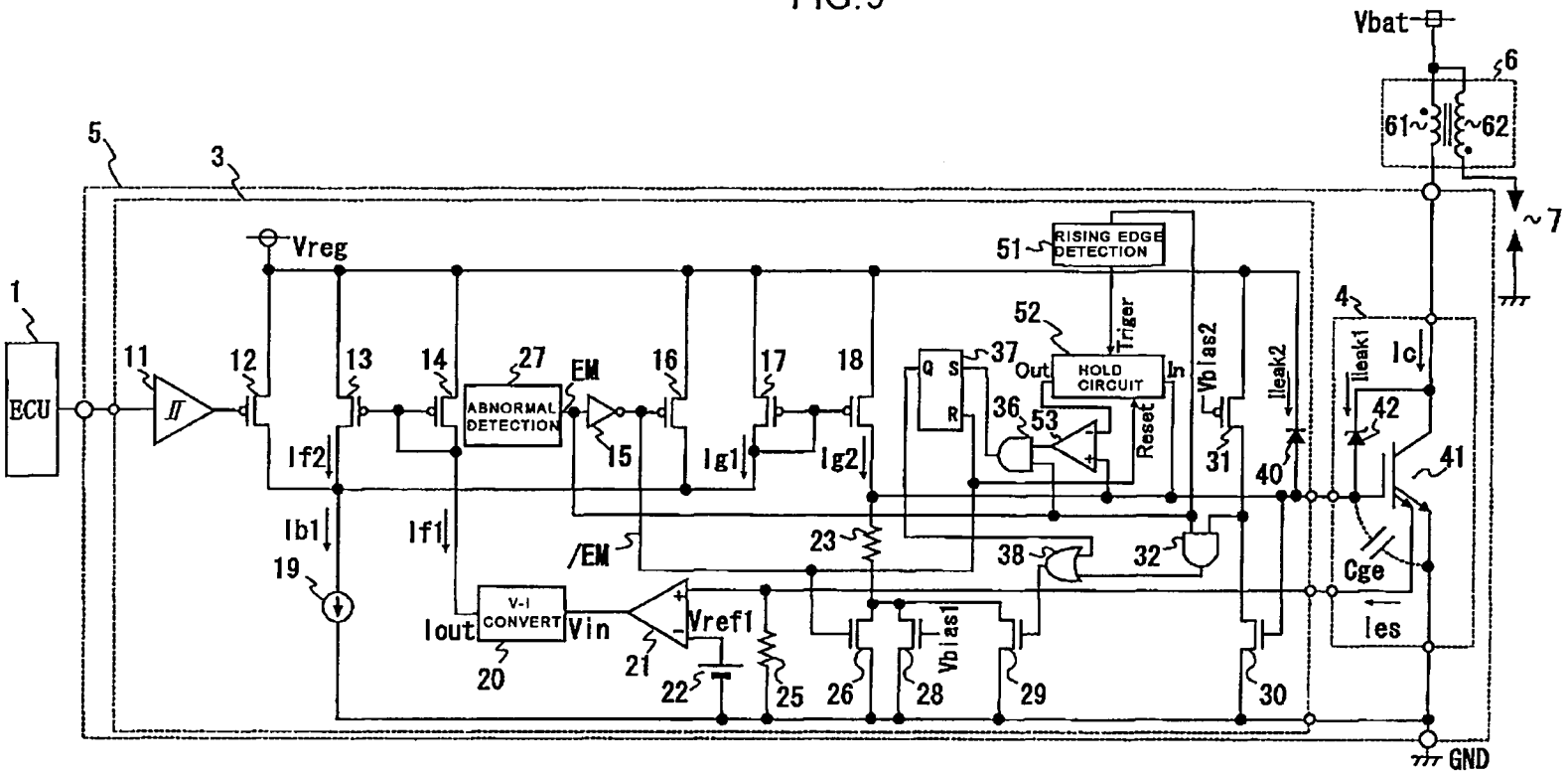
FIG. 9 is a circuit diagram showing an ignition system according to a fifth embodiment of the present invention.
Figure 10:
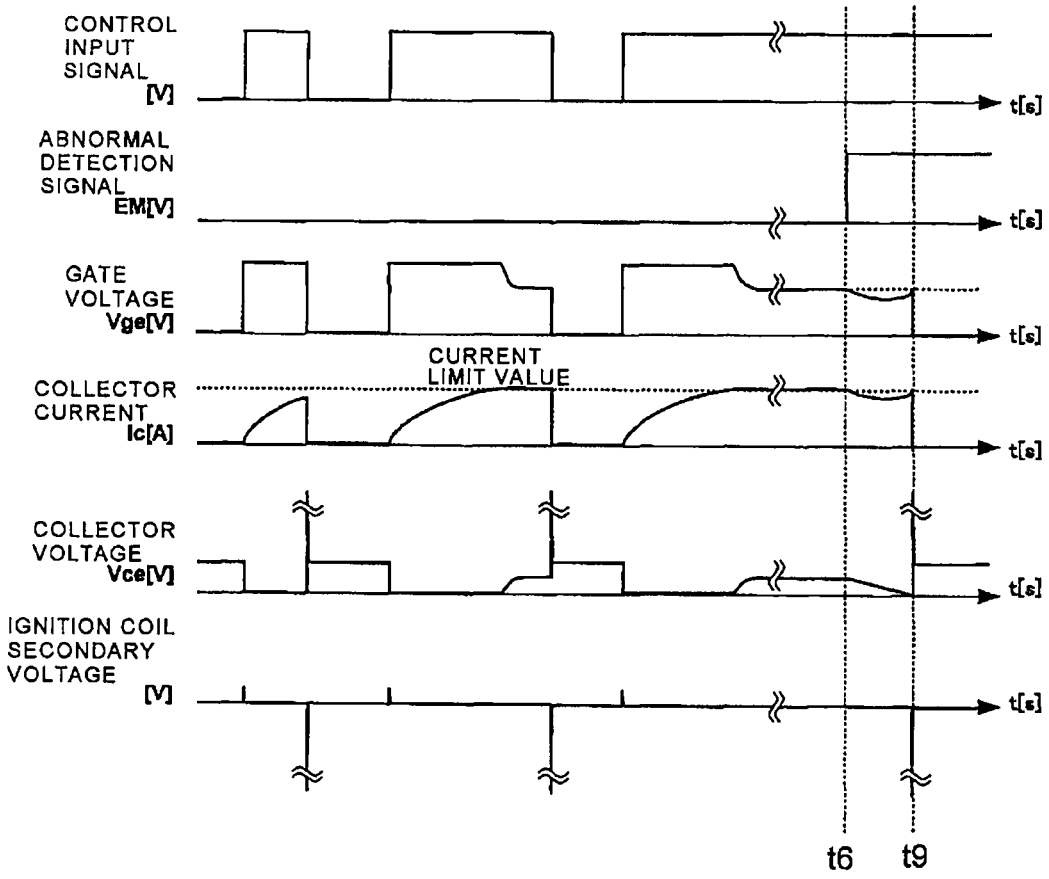
FIG. 10 is a timing chart for illustrating the operation of the ignition system according to the fifth embodiment of the present invention.

FIG. 9 shows a fifth embodiment of the igniter power semiconductor device according to the present invention. FIG. 10 shows a timing chart for explaining the operation in the fifth embodiment. In the fifth embodiment, emergency shutoff is performed in a case where the gate voltage rises at the time of soft shutoff at an abnormally high temperature, as is that in the fourth embodiment.

When at time t6 the abnormality detection signal EM becomes high level, the second discharge device with a high impedance is made effective, as described above. The gate voltage on the IGBT 41 at this time is stored in a gate voltage hold circuit 52. If the operation ambient temperature is so abnormally high that the surge protection diode 40 or the Zener diode 42 leaks, the gate voltage on the IGBT 41 starts temporarily decreasing, but the second discharge device cannot fully draw in the leak currents Ileak1 and the Ileak2 and the gate voltage starts, conversely, rising.

When at time t9 the gate voltage reaches the gate voltage value at the time of the start of soft shutoff stored in the hold circuit 52, the latch 37 is set to turn on the fourth Nch MOS 29. The first discharge device with a low impedance is thereby made effective to rapidly reduce the gate voltage.

Since the collector current Ic is rapidly shut off in this case, a voltage high enough to cause the ignition plug 7 to spark is generated on the secondary side of the ignition coil 6. However, the shutoff of the IGBT 41 is maintained by the latch 37 until the abnormal state is dissolved, thus protecting the IGBT 41.

As described above, shutoff in operation at an abnormally high temperature in the fourth and fifth embodiments is performed as an emergency operation. It is, therefore, desirable to make a notification of the emergency stop, for example, by returning a Q output from the latch 37 to the ECU 1. The notification enables execution of an abnormal condition recovery procedure such as a procedure in which the ECU 1 suitably restores the igniter power semiconductor device 5.

Sixth Embodiment

Figure 11:
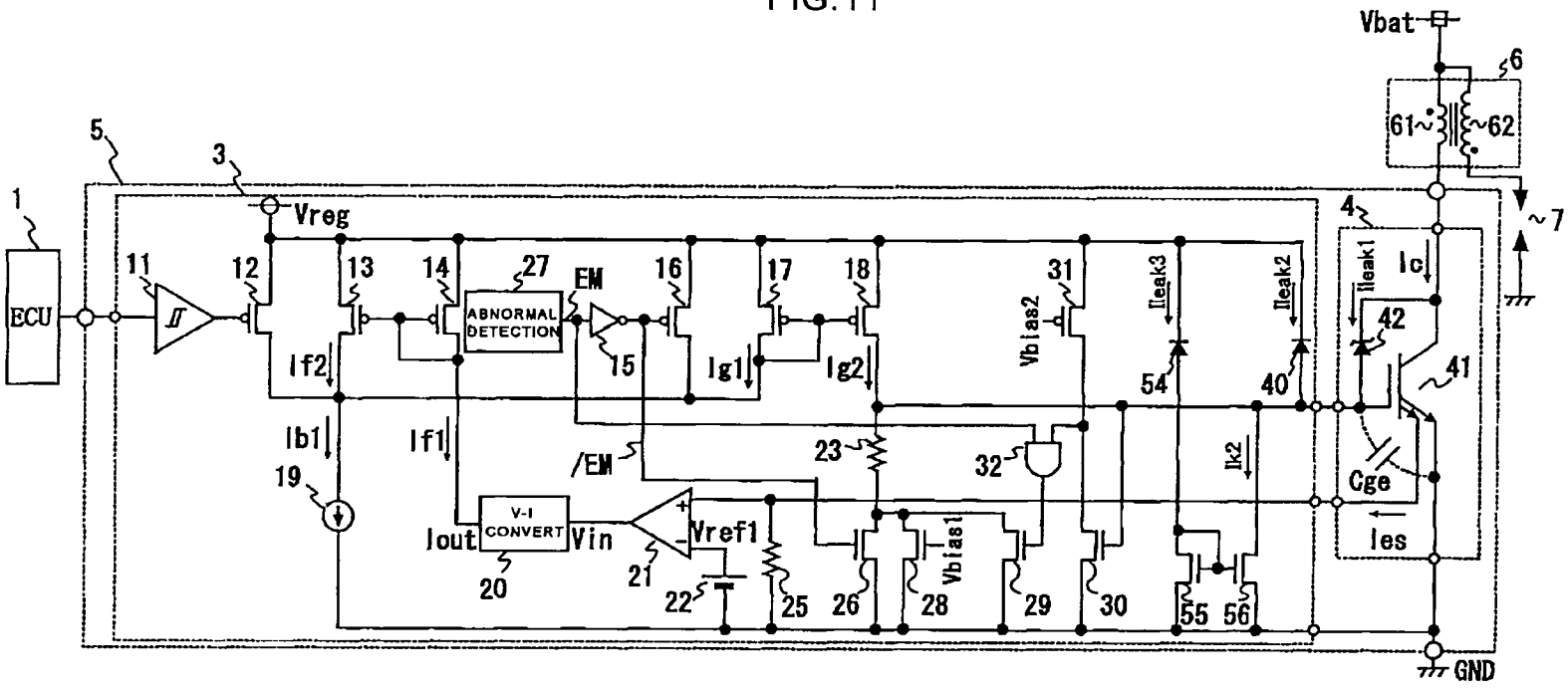
FIG. 11 is a circuit diagram showing an ignition system according to a sixth embodiment of the present invention.

FIG. 11 shows a sixth embodiment of the igniter power semiconductor device according to the present invention. The timing chart in the sixth embodiment is the same as that in the third embodiment shown in FIG. 6 and is therefore omitted.

In the fourth and fifth embodiments, the ignition plug 7 is caused to spark by an emergency rapid shutoff during operation at an abnormally high temperature. In the present embodiment, leak current compensation means for bypassing the leak currents Ileak1 and Ileak2 that cause an increase in the gate voltage is provided and soft shutoff is performed to prevent the ignition plug 7 from sparking even during operation at an abnormally high temperature.

Referring to FIG. 11, the leak current compensation means is constituted by a third current mirror circuit formed of a sixth Nch MOS 55 and a seventh Nch MOS 56, and a dummy diode 54. The size of the dummy diode 54 and the mirror ratio of the third current mirror circuit are adjusted in advance so that an output current Ik2 from the leak current compensation means is equivalent to the leak current Ileak2 through the surge protection diode 40 and the leak current Ileak1 through the Zener diode 42.

When the leak currents Ileak1 and Ileak2 are generated during operation at an abnormally high temperature, a leak current Ileak3 is also generated through the dummy diode 54, which is of the same kind. The leak currents Ileak1 and Ileak2 are bypassed to the reference power supply potential GND by the third current mirror circuit, thus avoiding increasing the gate voltage. In this way, soft shutoff can be performed without causing the ignition plug 7 to spark even during operation at an abnormally high temperature.

Obviously many modifications and variations of the present invention are possible in the light of the above teachings. It is therefore to be understood that within the scope of the appended claims the invention may be practiced otherwise than as specifically described.

The entire disclosure of a Japanese Patent Application No. 2009-284099, filed on Dec. 15, 2009 including specification, claims, drawings and summary, on which the Convention priority of the present application is based, are incorporated herein by reference in its entirety.

What is claimed is:

1. A power semiconductor device for an igniter, comprising:

a semiconductor switching device causing a current to flow through a primary side of an ignition coil or shutting off the current flowing through the primary side of the ignition coil;

an integrated circuit driving and controlling the semiconductor switching device;

wherein the integrated circuit includes:

a first discharge device discharging charge accumulated on a control terminal of the semiconductor switching device and shutting off the semiconductor switching device so as to generate an ignition plug spark voltage on a secondary side of the ignition coil during a normal operation, and a second discharge device slower discharging the charge accumulated on the control terminal of the semiconductor switching device in comparison with the first discharge device and shutting off the semiconductor switching device so that a voltage on the secondary side of the ignition coil is equal to or lower than the ignition plug spark voltage during an abnormal state; and a control terminal voltage observation circuit monitoring a voltage on the control terminal of the semiconductor switching device and shutting off the semiconductor switching device by the first discharge device when the second discharge device is shutting off the semiconductor switching device and the voltage on the control terminal of the semiconductor switching device becomes a predetermined voltage.

2. The power semiconductor device for an igniter according to claim 1, wherein the first discharge device includes a first resistor connected between the control terminal of the semiconductor switching device and a reference power supply potential, and the second discharge device includes a second resistor connected between the control terminal of the semiconductor switching device and the reference power supply potential, and having a larger resistance than a resistance of the first resistor.

3. The power semiconductor device for an igniter according to claim 1, wherein:

the first discharge device includes a first resistor connected between the control terminal of the semiconductor switching device and a reference power supply potential, and the second discharge device includes a constant-current source connected between the control terminal of the semiconductor switching device and the reference power supply potential and outputting a current which is smaller than a discharge current flowing through the first resistor.

4. The power semiconductor device for an igniter according to claim 1, wherein the control terminal voltage observation circuit shuts off the semiconductor switching device by the first discharge device when the voltage on the control terminal of the semiconductor switching device becomes equal to or lower than a threshold voltage of the semiconductor switching device.

5. The power semiconductor device for an igniter according to claim 1, wherein the control terminal voltage observation circuit shuts off the semiconductor switching device by the first discharge device when the voltage on the control terminal of the semiconductor switching device becomes equal to or higher than the predetermined voltage.

6. The power semiconductor device for an igniter according to claim 1, wherein the control terminal voltage observation circuit shuts off the semiconductor switching device by the first discharge device when the voltage on the control terminal of the semiconductor switching device becomes equal to or higher than a voltage on the control terminal of the semiconductor switching device at the time of the start of shutoff by the second discharge device.

7. The power semiconductor device for an igniter according to claim 1, further comprising:

a leak current compensation circuit discharging a leak current leaking to the control terminal to ground and preventing an elevation of the voltage on the control terminal when the second discharge device is shutting off the semiconductor switching device.

* * * * *